US007004410B2

(12) United States Patent
Li

(10) Patent No.: US 7,004,410 B2
(45) Date of Patent: Feb. 28, 2006

(54) SHOWER HEAD

(75) Inventor: Chun Kong Li, New Territories (HK)

(73) Assignee: Jing Mei Industrial Holding Limited, Rarotonga (CK)

( * ) Notice: Subject to any disclaimer, the term of this patent is extended or adjusted under 35 U.S.C. 154(b) by 0 days.

(21) Appl. No.: 10/640,447

(22) Filed: Aug. 13, 2003

(65) Prior Publication Data

US 2005/0035227 A1 Feb. 17, 2005

(51) Int. Cl.
*B05B 15/08* (2006.01)

(52) U.S. Cl. ..... 239/587.4; 239/587.1; 239/552; 239/575; 239/DIG. 4; 239/DIG. 23

(58) Field of Classification Search ..... 239/587.1, 239/587.2, 587.3, 587.4, 587.5, DIG. 4, DIG. 23, 239/548, 552, 575
See application file for complete search history.

(56) References Cited

U.S. PATENT DOCUMENTS

| | | | | |
|---|---|---|---|---|
| 4,275,843 | A | 6/1981 | Moen | |
| 4,324,364 | A | 4/1982 | Buzzi et al. | |
| 4,634,053 | A | 1/1987 | Herzfeld et al. | |
| 5,033,897 | A | 7/1991 | Chen | |
| 5,070,552 | A | 12/1991 | Gentry et al. | |
| 5,158,234 | A | 10/1992 | Magnenat et al. | |
| 5,167,431 | A | 12/1992 | Maifredi | |
| 5,201,468 | A * | 4/1993 | Freier et al. | 239/383 |
| 5,277,454 | A | 1/1994 | Lorch et al. | |
| 5,297,735 | A | 3/1994 | Heimann et al. | |
| 5,613,638 | A | 3/1997 | Blessing | |
| 6,007,002 | A | 12/1999 | Huber | |
| 6,015,171 | A | 1/2000 | Schorn | |
| 6,076,747 | A * | 6/2000 | Ming-Yuan | 239/587.4 |
| 6,123,308 | A | 9/2000 | Faisst | |
| 6,343,750 | B1 | 2/2002 | Engel | |
| 6,382,531 | B1 | 5/2002 | Tracy | |
| 6,412,710 | B1 * | 7/2002 | Lin et al. | 239/548 |
| 6,497,374 | B1 * | 12/2002 | Wu et al. | 239/587.4 |
| 2001/0008256 | A1 * | 7/2001 | Marsh et al. | 239/540 |
| 2002/0079699 | A1 | 6/2002 | Wurgler | |

FOREIGN PATENT DOCUMENTS

| | | |
|---|---|---|
| WO | WO 01/61234 | 8/2001 |

* cited by examiner

*Primary Examiner*—Steven J. Ganey
(74) *Attorney, Agent, or Firm*—Norris McLaughlin & Marcus PA

(57) ABSTRACT

A shower head generally comprising a face plate, an outer housing, a water chamber, a ball holder, a button, a seal, a nozzle, a screen filter, a pivot ball, and a label logo. The ball holder covers the pivot ball, wherein the pivot ball is flush with the seal which is disposed in the water chamber. In a preferred embodiment, the water chamber comprises two portions having two different diameters, wherein the ball holder is connected over the portion having the smaller diameter. The ball holder is simultaneously disposed on top of the portion having the larger diameter.

13 Claims, 5 Drawing Sheets

SHOWER HEAD

BACKGROUND OF THE INVENTION

The present invention relates to a shower head for use preferably with a wall bar set. More particularly, the shower head improves the pivot ball joint wherein the shower head swivels around the pivot ball for better reliability and stability. The shower head incorporates a flat-faced seal design wherein the pivot ball and the seal are substantially flush along a plane, and the seal is substantially flush with a water chamber. Further, the pivot ball is generally surrounded by a ball holder for better reliability.

A shower head is a common fixture for directing the spray of water. One of the main features of a shower head is its ability to pivot about a point for directional spraying. In other words, a user can configure a shower head according to his or her preferences. After constant use, however, the shower head may be unable to move into any particular direction. It might be stuck in one specific position or be completely incapable of movement and remain limp. Further, the worn-out shower head may leak in the pivot ball joint itself. The joint can suffer from wear-and-tear over time due to use and construction. Thus, one consideration in constructing a shower head is the pivot ball joint itself.

An automatically adjustable shower head is disclosed in U.S. Pat. No. 4,275,843, wherein a body member is shown attached to the lower half of the pivot ball. The pivot ball and the O-ring are not substantially flush, because the pivot ball extends beyond a horizontal plane established by the O-ring. Additionally, the O-ring is circular in its cross-section thereby providing less contact surface, and thus no ability to create a flat seal.

U.S. Pat. No. 4,324,364 discloses an adjustable shower head for producing adjustable sprays. Again, the holder covers the lower half of the pivot ball. The housing covers the remaining exposed portions of the pivot ball. The pivot ball is sealed by a ring, but the seal is not flat. Rather, the lower portion of the pivot ball extends beyond the horizontal plane of the seal created by the ring abutted against the pivot ball.

A shower head comprising a backing plate, a diaphragm and a cover plate are generally disclosed in U.S. Pat. No. 6,382,531 B1. The backing plate acts as a conduit for receiving and sending water, wherein the water is sent through the pivot ball. The pivot ball is attached to the backing plate. However, there is no such disclosure of a seal arrangement with the pivot ball.

The present invention solves the deficiencies stated in the prior art, while providing improvements as stated herein.

SUMMARY OF THE INVENTION

Accordingly, the present invention provides for a shower head comprising an outer housing having a top and bottom openings; a face plate enclosing said bottom opening; a nozzle having a top and bottom face, wherein said bottom face is connected to said face plate thereof; a water chamber including at least one channel, centrally disposed, axially throughgoing for flow-through of water; a ball holder fitted in said outer housing and encased by said top opening, wherein said ball holder is connected over said water chamber; a pivot ball connectable to a water supply, wherein said pivot ball includes a tubular portion which contains a screen filter and a spherical ball portion which is substantially surrounded by said ball holder; and a seal disposed in an annular groove of said upper portion, said seal having a relatively rectangular or square cross-section which abuts said pivot ball, and preferably is rendered substantially flush therewith by virtue of an angled cut in the abutting corner of the seal; and said seal is substantially flush with the bottom of said pivot ball and said annular groove along a plane.

A preferred embodiment comprises an outer housing having a top and bottom opening; a face plate enclosing said bottom opening; a nozzle having a top and bottom face, wherein said bottom face is connected to said face plate thereof; a water chamber having an upper portion and a lower portion connected to said top face, wherein the diameter of said upper portion is smaller than said lower portion; the water chamber including at least one channel, centrally disposed, axially throughgoing for flow-through of water, and a plurality of concentric circles defining a plurality of bores, wherein said at least one channel communicates with said bores; a ball holder fitted in said outer housing and encased by said top opening, wherein said ball holder is secured over said upper portion and on top of said lower portion; a pivot ball connectable to a water supply, wherein said pivot ball includes a tubular portion which contains a screen filter and a spherical ball portion which is substantially surrounded by said ball holder; and a seal disposed in an annular groove of said upper portion, said seal having a relatively rectangular or square cross-section which abuts said pivot ball, and preferably is rendered substantially flush therewith by virtue of an angled cut in the abutting corner of the seal; and said seal is flush with the bottom of said pivot ball and annular groove along a plane.

An object of the present invention is a shower head that is more stable as evidenced by the flat seal design created by the pivot ball and the ball holder, wherein the flat seal design prevents the undue leakage of water.

Another object is a shower head that is more reliable, wherein the life cycle of the ball joint is extended upon the ball holder fully encompassing the pivot ball.

These and other objects of the invention are best understood and more apparent when the detailed description and the accompanying drawings are read in conjunction with each other.

DESCRIPTION OF THE PREFERRED EMBODIMENTS

Figure 1:
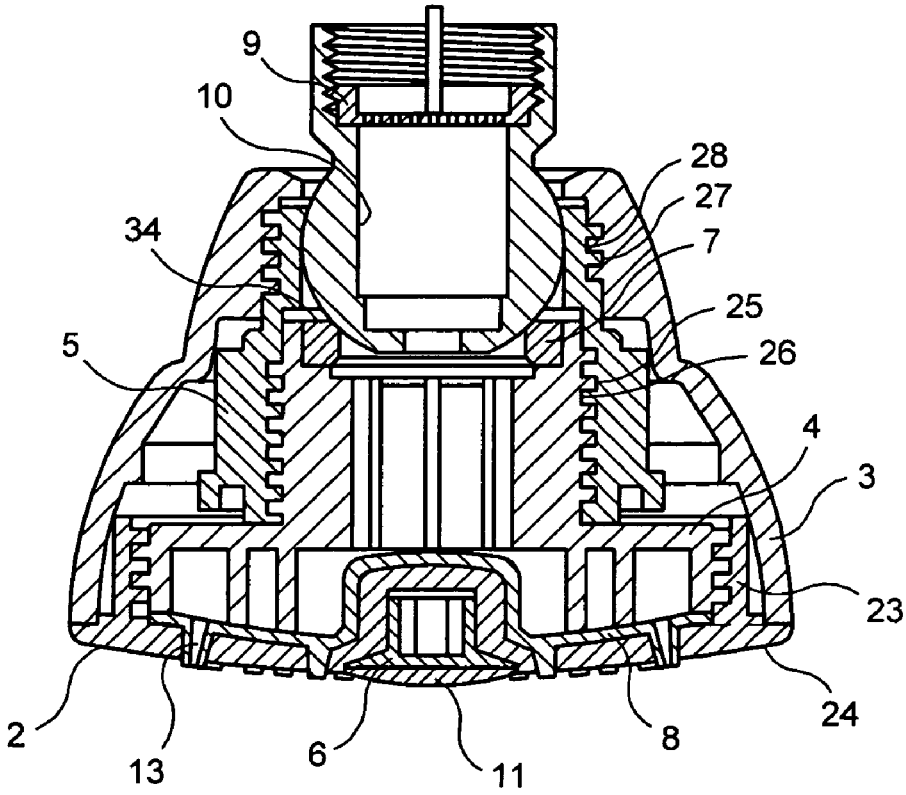
FIG. 1 is a sectional view of a preferred embodiment of the present invention showing the assembled shower head.

An assembled shower head (1) is shown in FIG. 1 comprising a face plate (2), an outer housing (3), a water chamber (4), a ball holder (5), a button (6), a seal (7), a nozzle (8), a screen filter (9), a pivot ball (10), and a label logo (11).

Figure 4:
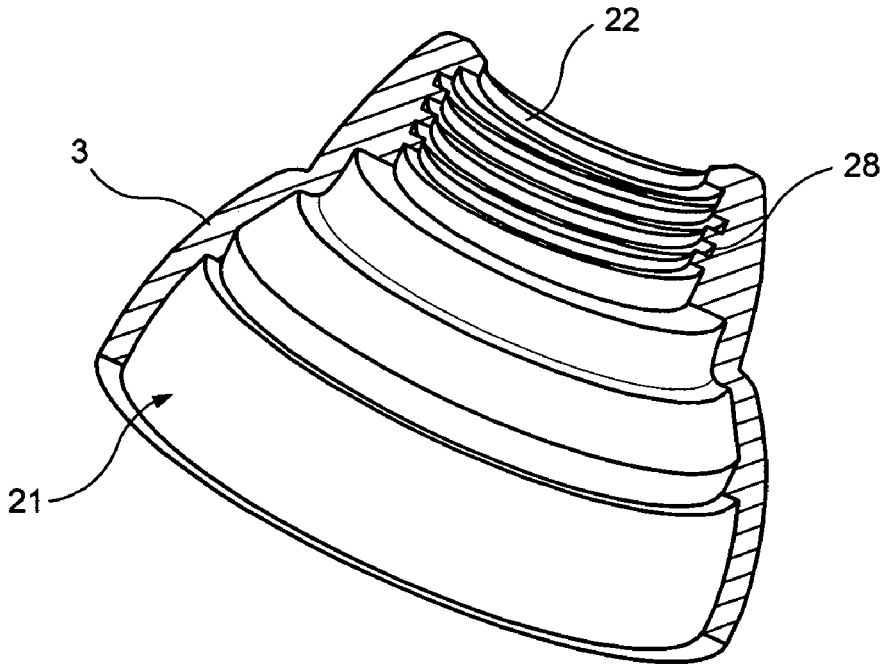
FIG. 4 is a sectional and perspective view of the outer housing.
Figure 5:
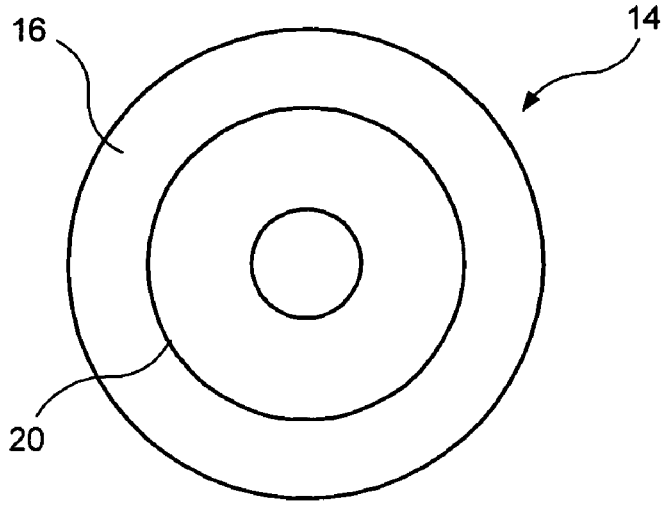
FIG. 5 is a plan view of the lower portion of the water chamber.
Figure 10:
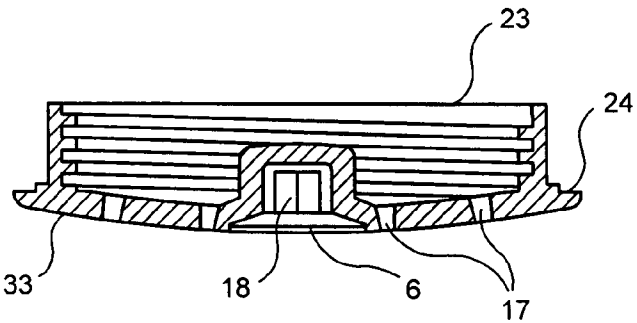
FIG. 10 is a sectional view of the face plate.

Referring to FIG. 4, an outer housing (3) having a top (22) and bottom (21) opening is generally decorative in nature and is preferably chrome-plated, wherein the interior portions of the shower head (1) are positioned within the outer housing (3). The outer housing (3) can be amended to different styles in accordance with specific market needs. When the shower head (1) is assembled, the outer housing (3) is connected to a face plate (2), wherein the face plate (2) encloses the bottom opening (21) by aligning the outer housing (3) with a medial face (24) of the face plate (2) as shown in FIG. 1. Referring to FIG. 10, the face plate (2) comprises the medial (24) and a lateral face (33), wherein apertures (17) traversing both faces (24, 33), a recess (18) situated in the center of the lateral face (33), and a collar (23) disposed from the edge of the medial face (24). The recess (18) has a shape and size that substantially corresponds to that of a button (6), wherein the button (6) is inserted into the recess (18) as shown in FIG. 1 of the assembled shower head (1). A label logo (11) covers the exposed outer surface of the button (6). The collar (23) has a length that substantially corresponds to the length of a lower portion (14) of the water chamber (4). The collar (23) and the lower portion (14) are preferably threaded as a securing means.

The ball holder (5) substantially covers the water chamber (4), preferably by a threaded collar or the like located on the water chamber (4), and is preferably fixed to the outer housing (2) by corresponding threads (27, 28) for attachment. The upper region of the ball holder substantially surrounds or covers the pivot ball (10) as shown in FIG. 1, while the lower region of the ball holder contains a threaded portion (25) or similar securing means in its interior that engages a corresponding securing means (26) on the exterior of the water chamber (4). The upper region of the ball holder (5) preferably substantially surrounds or covers a ball portion (30) of the pivot ball (10). The internal diameter of the ball holder (5) is smaller than the diameter of the pivot ball (10), so that the pivot ball (10) is engaged inside the ball holder (5) and unable to go through the top opening of the ball holder (5). The upper region of the ball holder (5) is fitted over the ball portion (30) until the pivot ball is engaged and is able to swivel within the ball holder. The lower portion of the pivot ball (10) is situated on top of the seal (7) and is compressed toward the seal (7) by tightening the ball holder (5) during assembly. Upon assembly, the pivot ball (10), ball holder (5) and seal (7) form a water-tight joint thereby allowing the pivot ball (10) to swivel. The interior of the upper region is preferably smooth and generally shaped to engage the pivot ball (10). The ball holder (5) is secured over the water chamber by preferably twisting or screwing over the water chamber (4). The ball holder (5) and the water chamber (4) are fastened together by preferably employing a square thread engagement. The exterior of the ball holder (5) may be provided with ribs (35) to facilitate the fastening and assembly of the shower head by power tools. Any other means of securement is also contemplated.

Figure 7:
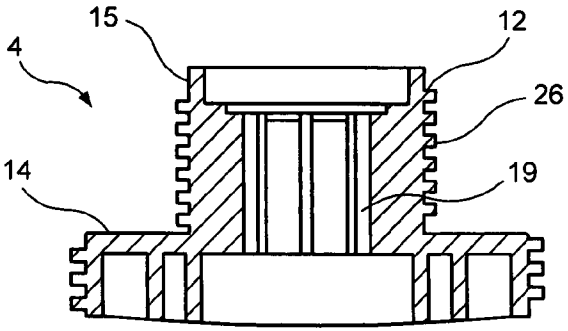
FIG. 7 is a sectional view of the water chamber.
Figure 8:
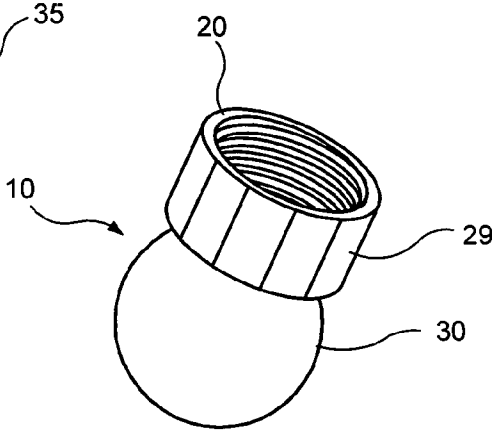
FIG. 8 is a perspective view of the pivot ball.
Figure 6:
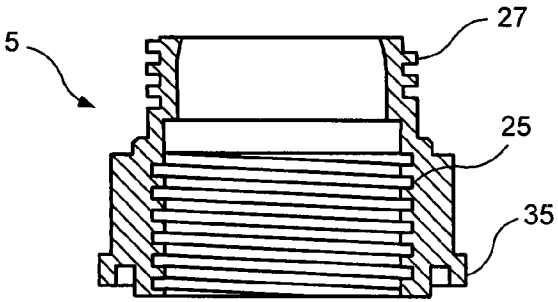
FIG. 6 is a sectional view of the ball holder.
Figure 9:
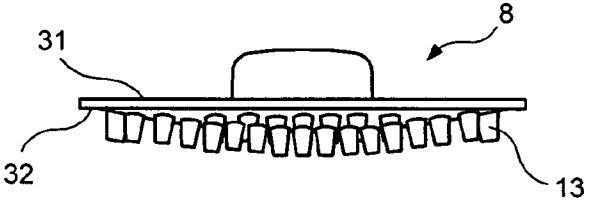
FIG. 9 is a side view of the nozzle.

Referring to FIG. 7, the water chamber (4) comprises a lower portion (14) and an upper portion (15) which includes at least one channel (19) extending therein and an annular groove (12). Both portions are generally tubular in shape; the upper portion (15) has a diameter that is generally equal to or less than the diameter of the lower portion (14). In a preferred embodiment, the lower portion (14) has a diameter greater than the upper portion (15) such that the ball holder (5) can fit on top of the lower portion (14) as seen in FIGS. 1 and 8. The annular groove (12) is positioned in axial alignment to the channel along a recessed edge of the upper portion (15). The channel (19) is centrally located and extends along the length of the upper portion (15) and lower portion (14) to facilitate the passage of water from the pivot ball (10). In a preferred embodiment, the channel (19) is connected to a plurality of concentric circles (20) in the lower portion (14) which define a plurality of bores (16). The concentric circles (20) may also protrude slightly downward from the water chamber (4).

The pivot ball (10) is attachable to the water supply and is preferably made of brass. It is generally shaped to have a generally tubular portion (29) and the ball portion (30) in the shape of a sphere truncated at its top and bottom. The tubular portion (29) contains an opening (20) at its top for accommodating a screen filter (9). The shape of the screen filter (9) conforms to the shape of the opening (20). The screen filter (9) is inserted into the opening (20) insofar as resistance is felt as the screen filter (9) passes from the tubular portion (29) towards the ball portion (30) as shown in FIG. 1. The opening (20) is preferably threaded for easier insertion of the screen filter (9).

Figure 1A:
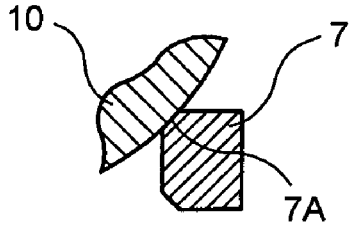
FIG. 1A is a partial, sectional view of FIG. 1.
Figure 2:
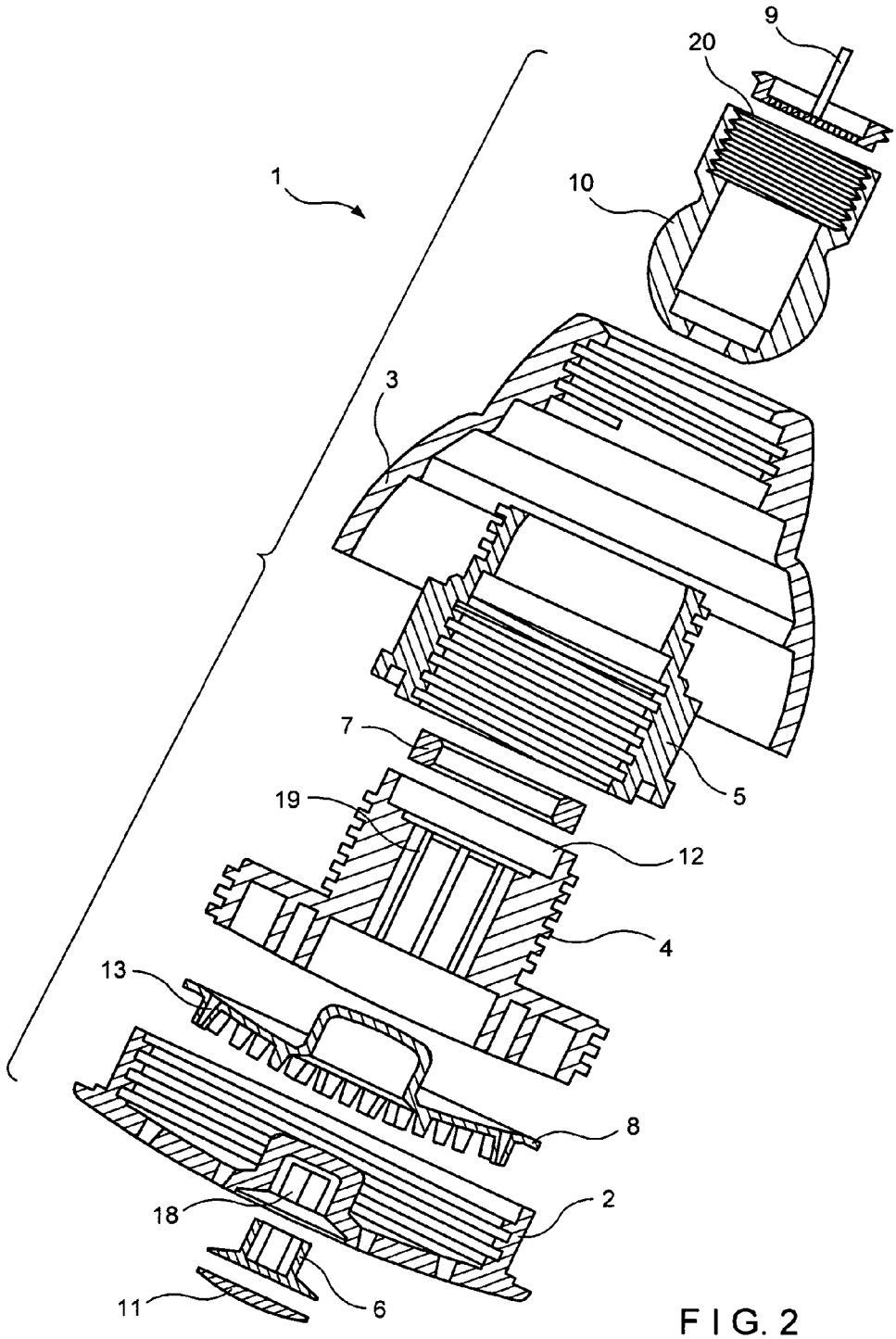
FIG. 2 is a sectional and exploded view of the shower head shown in FIG. 1.
Figure 3:
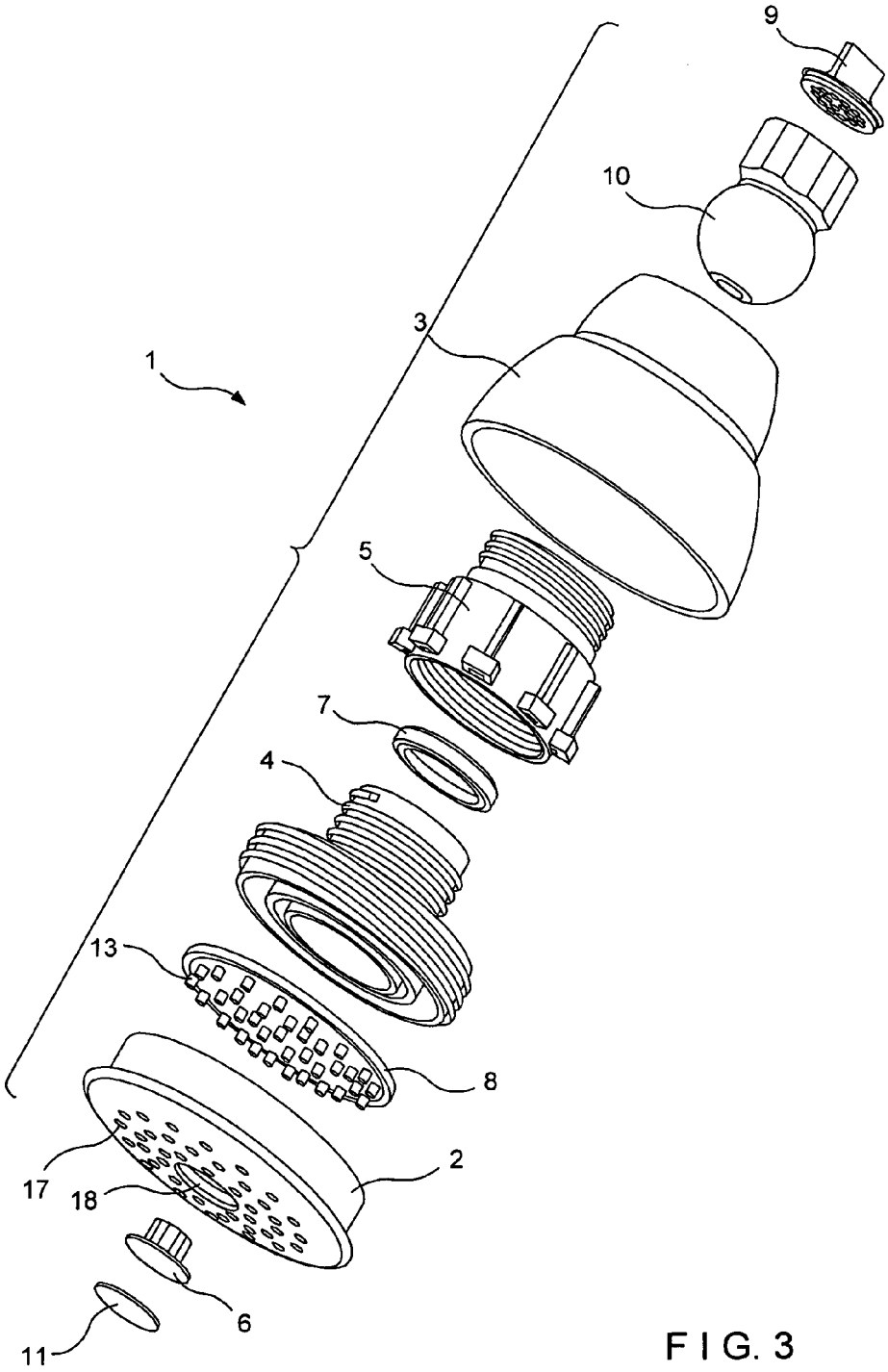
FIG. 3 is an exploded view of the shower head shown in FIG. 1.

The seal (7) is generally annular and is pre-loaded with a tensile force, where the seal (7) sits in the annular groove (12) of the water chamber (4) such that the seal (7) is abutted against the pivot ball (10). The seal (7) is shaped to generally conform to the shape of the annular groove (12), such that the seal (7) is generally contiguous with the lower portion (14) of the water chamber (4). As shown in FIG. 1 and FIG. 1A, the seal (7) has a relatively rectangular or square cross-section and is flush with the bottom of the pivot ball (10) and the annular groove (12) along a plane to create a sealing contact. The outer surface of the seal (7) is generally flat and substantially flush with the water chamber (4) when the seal (7) is disposed in the annular groove (12). The inner surface 7A of the seal (7) is preferably cut inwardly at an inside corner (34) and at an angle relative to the shape of the pivot ball as seen in FIG. 1 and FIG. 1A, such that when the seal (7) is disposed in the annular groove (12) it sits substantially flush against the pivot ball (10). The angle of the cut on the seal (7) may vary in construction, depending on where it is to sit relative to the outer surface of the pivot ball, and may be determined by the skilled person so as to be an angle corresponding to the angle of the abutting region of the pivot ball. In a preferred embodiment, the angle may be 45° from the vertical and will reside substantially flush with the outer surface of the bottom of the pivot ball, at a point where the angle of the surface of the pivot ball is also 45°. Likewise, the skilled person will understand that if the shower head is constructed such that the seal will abut the pivot ball where the angle of the surface of the pivot ball is 75°, i.e. towards bottom of the ball, the conforming angle of the cut of the seal should also be about 75°. It should be understood that, as the seal is preferably made of a compressible material, the angle may slightly differ, yet may sufficiently conform to the surface of the ball upon pressure applied thereto. The seal (7) is preferably made of rubber, and most preferably EPDM.

The nozzle (8) has a shape and size that corresponds to that of the water chamber (4) and the face plate (2). The nozzle (8) has a top (31) and bottom face (32), wherein the top face (31) is connected to the water chamber (4) and the bottom face (32) is connected to the face plate (2). Specifically, the top face (31) is connected to the lower portion (14) of the water chamber (4). The nozzle (8) is effectively "sandwiched" between the water chamber (4) and the face plate (2), wherein the nozzle (8) is pressed downward onto the face plate by the concentric circles (20 of the water chamber (4). The nozzle (8) includes a plurality of nipples (13) extending outward to regulate the amount of water that it receives from the water chamber (4). The number of nipples (13) should correspond to the number of apertures (17) in the face plate (2), wherein the nipples (13) are aligned with the apertures (17) of the face place (1) such that the nipples (13) can pass through the apertures (17).

What is claimed is:

1. A shower head comprising, an outer housing having a top and bottom opening;

a face plate enclosing said bottom opening;

a nozzle having a top and bottom face, wherein said bottom face is connected to said face plate thereof;

a water chamber having an upper portion and a lower portion connected to said top face, wherein the diameter of said upper portion is equal to or smaller than said lower portion;

a ball holder fitted in said outer housing and encased by said top opening, wherein said ball holder is secured over said water chamber;

a pivot ball connectable to a water supply, wherein said pivot ball includes a tubular portion which contains a screen filter and a spherical ball portion which is substantially surrounded by said ball holder; and a seal disposed in an annular groove of said upper portion, said seal having a relatively rectangular or square cross-section which abuts said pivot ball, and wherein said seal is flush with the bottom of said pivot ball and annular groove along a plane.

2. The shower head of claim 1, wherein said water chamber further comprises at least one channel, centrally disposed, axially throughgoing for flow-through of water, and a plurality of concentric circles defining a plurality of bores, wherein said at least one channel communicates with said bores.

3. The shower head of claim 1, wherein a corner of said seal abutting an outer surface of the pivot ball is cut at an angle which substantially corresponds to an angle of said pivot ball at a location where the pivot ball abuts the seal, such that said seal is substantially flush against said pivot ball.

4. The shower head of claim 3, wherein the angle is from 45° to 90° from the vertical.

5. The shower head of claim 1, wherein said seal is flush with said upper portion when said seal is disposed in said annular groove.

6. The shower head of claim 1, wherein said water chamber comprises a threaded collar for connecting said ball holder over said water chamber.

7. The shower head of claim 1, wherein said ball holder is connected over said upper portion and disposed on top of said lower portion.

8. The shower head of claim 1, wherein said nozzle comprises a plurality of nipples on said bottom face extending outward therefrom.

9. The shower head of claim 1, wherein said face plate comprises a medial face, a lateral face, a recess disposed in the center of said lateral face for insertion of a button, a collar disposed in said medial face, and a plurality of apertures for receiving said plurality of nipples.

10. The shower head of claim 9, wherein said recess has a shape and a size that corresponds to said button.

11. The shower head of claim 1, wherein said annular groove is disposed on a recessed edge of said upper portion adjacent said channel.

12. The shower head of claim 1, wherein said outer housing further comprises a threaded portion proximate to said upper opening.

13. The shower head of claim 1, wherein said seal is made of EPDM.

* * * * *